United States Patent [19]

Burnett

[11] Patent Number: 4,968,187

[45] Date of Patent: Nov. 6, 1990

[54] SYSTEM FOR BACKFILLING A SUBTERRANEAN VOID

[76] Inventor: Mackenzie Burnett, 78 Old Framingham Rd., Sudbury, Mass. 01776

[21] Appl. No.: 373,614

[22] Filed: Jun. 27, 1989

Related U.S. Application Data

[63] Continuation of Ser. No. 162,813, Mar. 1, 1988, abandoned.

[51] Int. Cl.[5] ..... E02D 3/12

[52] U.S. Cl. ..... 405/269; 405/267; 405/258

[58] Field of Search ..... 405/128, 132, 258, 263, 405/267, 269

[56] References Cited

U.S. PATENT DOCUMENTS

| | | | |
|---|---|---|---|
| 1,404,112 | 1/1922 | Goebl et al. | 405/258 |
| 3,440,824 | 4/1969 | Doolin | 405/267 |
| 3,786,639 | 1/1974 | Pineno et al. | 405/267 |
| 4,601,612 | 7/1986 | Primrose | 405/269 |
| 4,666,346 | 5/1987 | MacLeod | 405/258 |

*Primary Examiner*—Dennis L. Taylor
*Assistant Examiner*—Arlen L. Olsen
*Attorney, Agent, or Firm*—Robert F. O'Connell

[57] ABSTRACT

A system for filling a spatial volume below the earth's surfaces with a dry fill material by supplying the dry fill to a borehole at the surfaces, the fill falling generally vertically through the borehole so as to exit vertically at an exit thereof into the spatial volume. An ejector is positioned below the exit and provides a high velocity air stream which intercepts the dry fill as it exits from the borehole so as to direct the fill in a generally horizontal direction away from the borehole into the spatial volume.

10 Claims, 3 Drawing Sheets

SYSTEM FOR BACKFILLING A SUBTERRANEAN VOID

This is a continuation of co-pending application Ser. No. 07/162,813 filed on Mar. 1, 1988.

INTRODUCTION

This invention relates generally to techniques for controlling surface subsidence of underground voids, such as abandoned mines and tunnels, and the like, and, more particularly, to improved techniques for backfilling such subterranean voids.

BACKGROUND OF THE INVENTION

Subsidence control of generally empty spatial volumes below the earth's surface, i.e., subterranean voids, such as abandoned underground mines or tunnels, is a continuing problem especially in regions where subsequent surface development above the mine or tunnel has taken place. Most abandoned mines are normally accessible only through boreholes drilled from the surface into the mine cavity Common methods currently used for control of subsidence and stabilization of such underground mines include slurry backfilling, pneumatic backfilling, or cement grouting backfilling techniques.

Slurry backfilling has some advantages in that it is a generally low cost technique which is helpful for large scale projects where gravel or other mine refuse is readily available at or sufficiently close to the site which is to be backfilled. However, slurry backfilling technique often tend to cause further subsidence at some project sites and the technique has generally been avoided by those in the art for several years. An example of a slurry backfilling approach is disclosed in U.S. Pat. No. 3,817,039, issued to J. D. Stewart et al on June 18, 1974.

Cement grouting techniques normally use concrete columns which are formed by pumping concrete through a plurality of boreholes so as to provide support under surface structures. While such technique provides reasonably good support it is highly costly and is normally used on a relatively limited basis where its high cost can be justified.

A pneumatic, or dry, injection technique can be an effective method of backfilling underground mines with dry fill material if the subterranean cavity itself is not already flooded with water. Dry injection is often necessary to prevent the ground water contamination which is caused by using slurry methods. Further dry injection methods are used instead of slurry backfill techniques because the latter may tend to cause additional subsidence due to the flow of the water and fill material combination into an otherwise dry mine. Even though dry injection techniques tend to be higher in cost per ton than slurry injection methods, they can be economically feasible if the mine void volume is relatively small since no water wells are needed and no large pipe network is required. Accordingly, dry injection methods are often the more desired methods of the art when the subterranean void is relatively dry.

A commonly used dry injection technique is similar to the pump/slurry method disclosed in the aforesaid Stewart et al patent, except that air is used as the conveying fluid instead of water. Air at a relatively low pressure and high volume is blown into a gravel, or other fill material, metering device, such as a pocket feeder or lockhopper device. The fill material, e.g. sand, gravel, or a combination thereof, or some other solid fill material, is conveyed into a lockhopper via a conveyor belt or similar conveying device. The lockhopper feeds the fill material into an airstream conduit, the air and fill material passing vertically through the conduit to the mine void in a manner such as is shown in FIG. 1. Such a method raises at least two major problems.

First, the material is not effectively directed into the mine at the entry point thereof by any deflection, or flow turning, device, i.e. the flow material is merely directed downwardly in a vertical direction from the conduit exit and the fill material does not extend very far beyond the bottom of the conduit. Secondly, the pocket feeder or lockhopper is subject to extensive wear, especially at the seal faces which must seal the air and the abrasive fill material.

Typically, the fill materials which have been most often used for such dry injection method are flyash, sand or gravel, or other similar materials. While flyash tends to work reasonably well in that it flows relatively freely in the mine void so as to allow relatively large amounts of material to be injected at each borehole, such material is usually not utilized because it is not readily available and is relatively costly. Sand and/or gravel are generally more readily available and more economical to use. When the latter material is transported pneumatically, it can be moved relatively easily down the borehole pipe but, as it enters the mine void through the vertical borehole, it builds up a conical pile of material beneath the borehole as shown in FIG. 1. The conical pile assumes a general angle of repose and then builds up to a height where it reaches the bottom of the borehole pipe so that the flow is thereupon choked off and no further fill material can enter the void.

Various methods have been tried in order to mechanically direct the downward flow away from the exit end of the borehole pipe so that the direction of travel of the fill material is deflected away from the vertical. For example, elbows or other baffles or deflection surfaces are positioned at or in the bottom of the borehole pipe but such devices achieve little or no success when used with abrasive materials such as sand and/or gravel, and the like. The high velocity airflow at the pipe exit, e.g., up to 140 feet per second, tends to cause the abrasive fill material to bombard whatever deflection or turning device is installed at the end of the borehole pipe and, thereby, bring about rapid wear thereof, and subsequent failure of the device.

As a result of the problems which have arisen with the injection of dry solid fill materials, an alternative solution currently used in the field is to drill a plurality of boreholes at strategic locations over the subterranean void and to blow solid material straight down through each borehole without using any deflection devices. Such an approach further unduly increases the cost and time needed to back fill the subterranean void.

It is desirable to devise a technique for performing such backfill operation at a reasonable cost and avoid the problems which arise in using the above discussed techniques.

BRIEF SUMMARY OF THE INVENTION

In accordance with the invention, a system used for filling a generally empty volume of subterranean space with fill material utilizes a borehole means which extends generally vertically from the surface to the spatial volume. A feeding means feeds the fill material to the top of the borehole at the surface at a selected flow rate. The fill material flows down through the borehole pipe by gravity and exits at the open bottom end thereof. An ejector means, which comprises one or more air injection nozzles, is positioned just below the exit end of the borehole means and provides a high-velocity air stream for intercepting the fill material as it exits from the borehole means so as to cause the fill material to move in a direction generally horizontally away from the exit end thereof into the open spatial volume so as to fill such volume to a reasonably long distance from the borehole exit.

By using the technique of the invention, a single injection borehole can replace the multiple injection boreholes which are currently often used when utilizing a low pressure, lockhopper dry injection system. Moreover, no part of the system of the invention is subject to excessive wear since the fill material can be supplied to the borehole feed pipe by using conventional conveying systems to be carried by gravity to the mine void where the work of accelerating and directing the material is performed by air flow alone.

BRIEF DESCRIPTION OF THE DRAWINGS

The invention can be described in more detail with the help of the accompanying drawings wherein.

DESCRIPTION OF THE INVENTION

Figure 1:
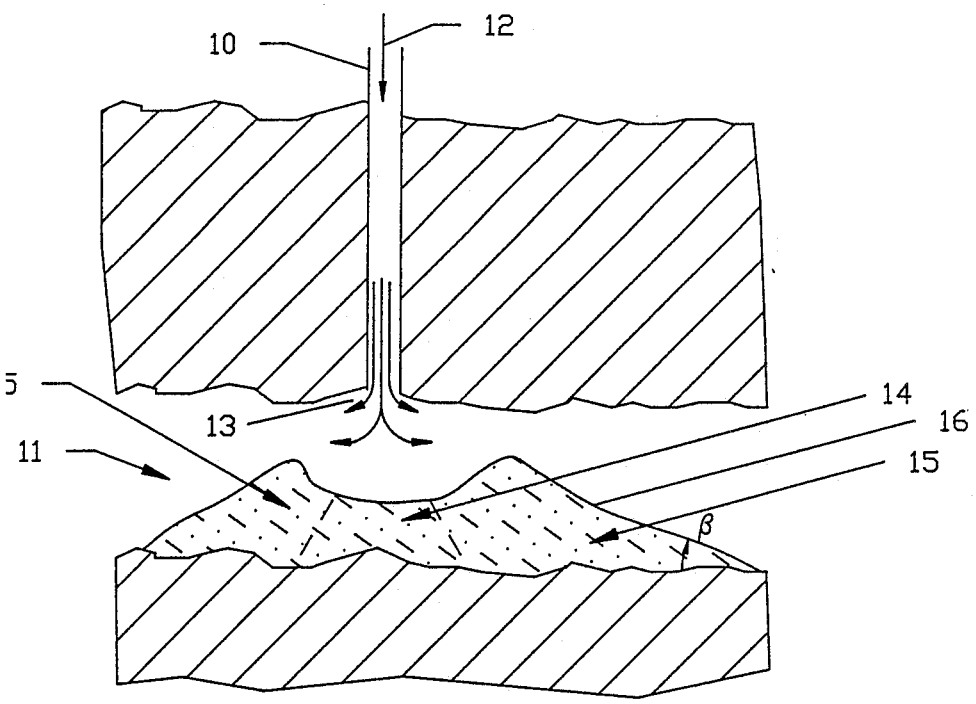
FIG. 1 PRIOR ART
FIG. 1 shows a typical borehole configuration operating in accordance with the prior art.

As can be seen in FIG. 1, in a system utilizing a borehole casing or pipe 10 which extends from the surface to the subterranean void 11, solid fill material is directed downwardly through the borehole pipe by using relatively high velocity air for propelling the solid materials therethrough, as shown by arrow 12. Particles of solid fill material are directed generally vertically outwardly from the exit end 13 of borehole pipe 10 so as to come to rest on the floor of subterranean void 11, coarser and heavier materials particles tending to collect in the region 14 directly below the pipe and finer and lighter particles tending to fall to the regions 15 at either side of the pipe opening. The fill material thereby tends to form a conical pile 14 which builds up to point a which it reaches the exit opening of pipe 10 and blocks off the passage of any further fill material that is directed downwardly from the pipe. Accordingly only a portion of the subterranean void 11 is filled with fill material and that portion extends only a relatively short distance from the pipe opening. In current systems a number of such borehole delivery systems must be strategically positioned at various locations above the subterranean cavity so as to more effectively fill the void.

Figure 2:
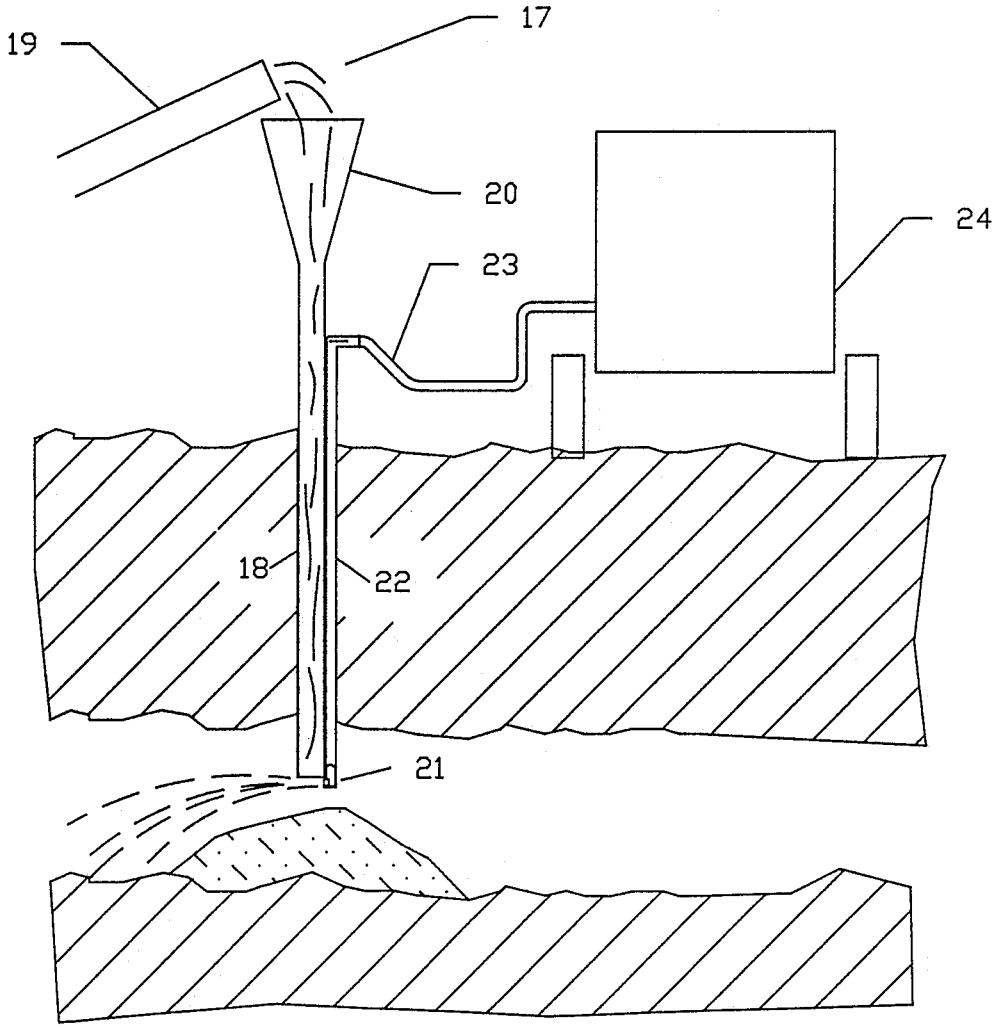
FIG. 2 shows a diagramatic view of a system in accordance with the invention.

A particular embodiment of a dry injection system in accordance with the invention is shown in FIG. 2. The system provides for a generally horizontal projection of a fill material into a mine entry point without providing excessively high wear on any part of the equipment associated therewith as would be the case in a conventional pneumatic injection technique, particularly one which uses some kind of baffle or other deflection surfaces at the exit end of the borehole.

Figure 3:
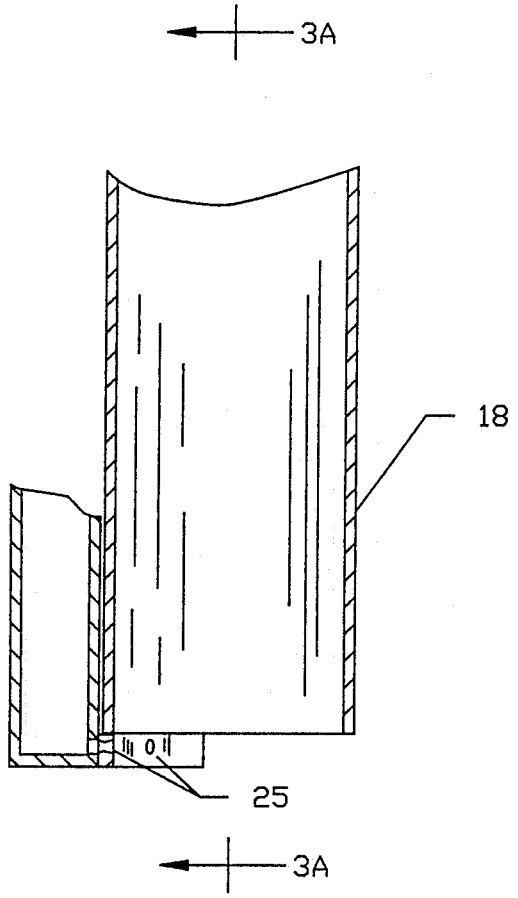
FIGS. 3, 3A and 3B, 4 and 4A, and 5 and 5A, show diagramatic views of three specific embodiments of the ejector portion of a system in accordance with the invention.
Figure 4:
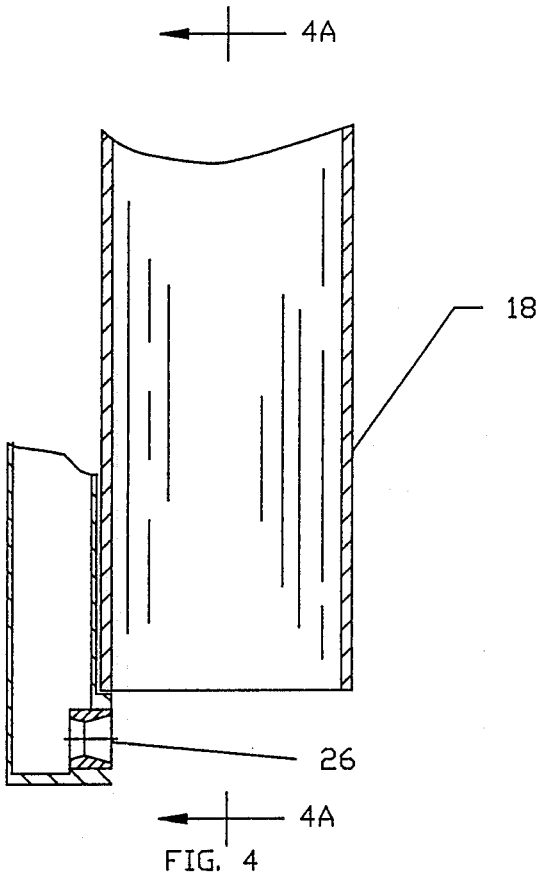
Figure 5:
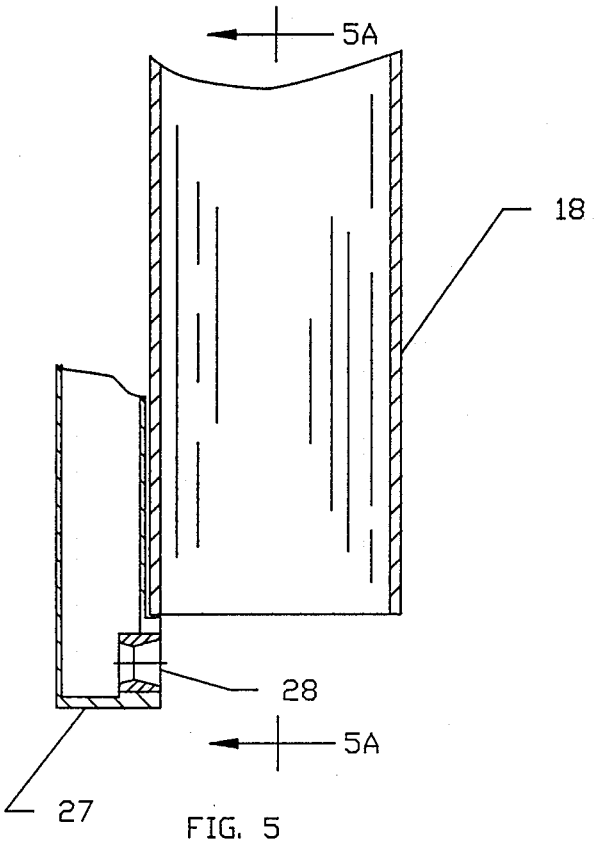

As can be seen in FIG. 2, a fill material 17 is metered into a cased borehole pipe 18 via a suitable feeder or conveyor mechanism 19, such as a screw feeder, a belt feeder, or any similar metering device. The fill material is delivered to an input hopper 20 of the system at a selected delivery rate, whereupon the material falls by gravity vertically downwardly to the bottom of the borehole casing. The vertically falling material is intercepted as it exits the pipe 18 by a high-velocity air stream which accelerates the material in a trajectory direction which is horizontal, or nearly horizontal. The air stream is created by a manifold and nozzle arrangement 21, wherein an air stream is created by the expansion of high pressure air through one or more suitable nozzles as shown in FIGS. 3, 4 and 5 and dicussed below, which nozzles, in a preferred embodiment, can be converging-diverging (CD) supersonic nozzles the design of which would be readily known to those in the art as discussed for example, in Perry's Chemical Engineer's Handbook, R. H. Perry and D. Green, McGraw-Hill Book Co., New York, 6th Edition, 1950 Section 5. While in many applications the creation of a supersonic airstream may be preferred, in other applications the nozzles or nozzles need not be supersonic in nature.

The nozzles can be sized to achieve the selected velocities at the nozzle exit using well known thermodynamic principles. For a typical available pressure of 100 to 125 pounds per square inch gage (psig), an exit velocity range of air from 1660–1720 feet per second can be achieved, for example, using a supersonic nozzle configuration.

An air pipe 22 is attached to the manifold and nozzle arrangement and extends generally parallel to the vertical feed drop pipe 18. Air pipe 22 can be suitably clamped as needed at the surface and a flexible hose 23 is used to connect the air pipe to an air compressor 24 located at the surface.

The manifold and nozzle arrangement is suitably attached to the bottom of the feed pipe 18 just below the exit end thereof, as shown in FIGS. 3, 3A, 3B, 4, 4A, 5 and 5A. The number of nozzles used can be varied and three typical designs are discussed in such figures.

Figure 3A:
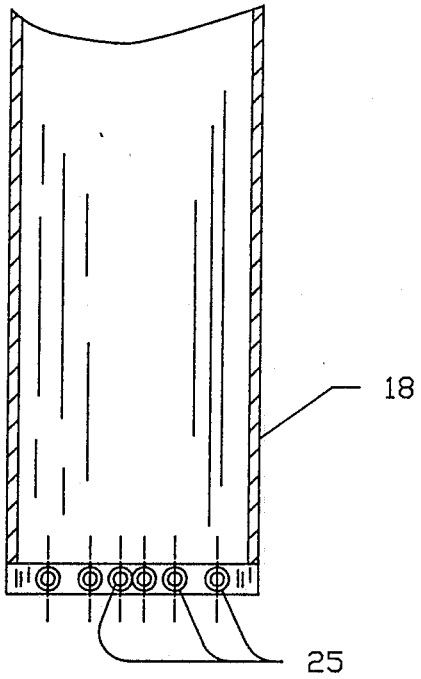
Figure 3B:
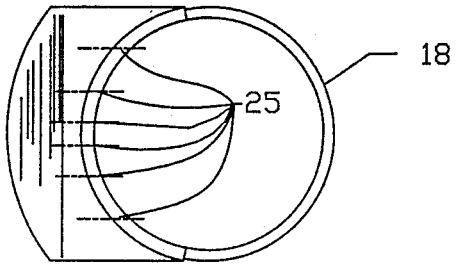

As shown in FIGS. 3, 3A and 3B, six CD nozzles 25 are spaced below the bottom exit plane of borehole pipe 18. The plurality of spaced nozzles 25 in effect, create a sheet of supersonic air which intercepts the fill material as it exits from the borehole pipe 18 deflecting the material generally in a horizontal direction and accelerating it to relatively high velocities. For example, solids velocities up to 100 to 500 feet per second can be achieved. As seen in FIGS. 3A and 3B, the spacing of the nozzles may be such that they are unequally spaced around a portion of the periphery of the borehole pipe.

Figure 4A:
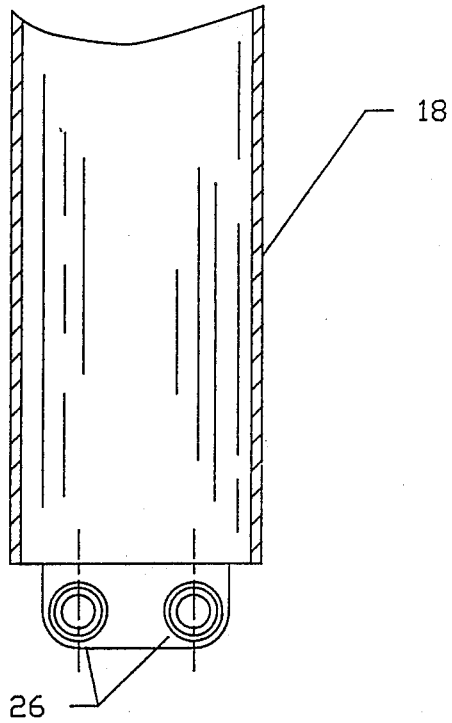

The configuration in FIGS. 4 and 4A utilizes only two nozzles 26, the diameters thereof being larger than those of the six nozzles shown in FIGS. 3, 3A and 3B. To obtain substantially the same overall flow rates in the two embodiments, the total of the output areas of the nozzles in each embodiment are about equal. It has been found that, while the overall volume of falling material can be better intercepted by using a relatively larger number of nozzles as in FIGS. 3, 3A and 3B, the velocity of the high velocity jet or sheet of air tends to deteriorate as it penetrates the fill material at the exit end of pipe 18. An ejector using fewer nozzles, but having relatively larger diameters for a given flow rate of fill material, have the same ejector area but less total boundary area than one using a larger number of smaller diameter nozzles for substantially the same flow rate. Accordingly, a design with fewer nozzles tends to permit greater penetration through the exiting material.

Figure 5A:
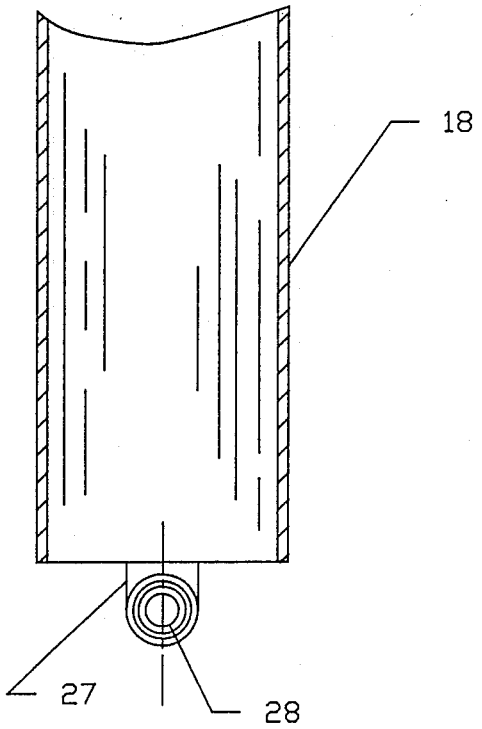

An ejector structure 27 using a single nozzle 28 is shown in FIGS. 5 and 5A and is a relatively simple design in terms of its construction as compared with those in FIGS. 3, 3A, 3B or FIGS. 4 and 4B. Fill material exiting at or near the peripheral edges of borehole pipe 18 that is not intercepted by air tends to fall vertically directly to the floor around the mine or subterranean void so that a generally conical pile of material builds up from the floor around the periphery of borehole 18 until it reaches at or near the bottom of ejector 27 and the exit end of borehole 18. When the fill material can no longer fall below the ejector because it is blocked by the conical pile built up of previously fallen peripheral fill material, the newly falling peripheral material will then tend to be forced to mix with the air stream and the conical pile itself will act as a baffle or deflecting region. Such a configuration can work effectively so long as the feed rate of the falling material does not exceed the capability of the nozzle to blow the material from the pipe end. The use of a larger diameter nozzles tends to permit greater penetration of the fill material into the void region.

The system of FIGS. 4 and 4A using a pair of nozzles at the ejector tends to represent a reasonable compromise between the use of a single nozzle, which provides greater penetration of fill material into the void, but less dispersion thereof, and a large number of nozzles which creates good dispersion characteristics but less penetration into the void. In the three designs discussed above, in using various feed mechanisms which may be available to those in the art, the feed rate selected for supplying the material to the borehole pipe 18 is critical to the performance of the ejector because the latter works on the principle of momentum transfer from the high velocity air stream to the fill material. The operation of accelerating and redirecting the fill material falling through the borehole pipe exit to a horizontal, or near horizontal, direction essentially occurs by such transfer of the momentum of the high-velocity jet stream to the solid fill material particles.

The transfer of the momentum of a supersonic airstream to a fill material can be accomplished without any mechanical deflecting or turning devices. Thus, the falling material has momentum in a downwardly vertical direction. If the airstream is generally horizontal, e.g., at a 90° angle with respect to the vertically falling solid stream, the resultant angle of the mix of solid material and air will be at some angle generally below the horizontal, such angle depending on the input feed rate of the solid material, the air flow rate of the air jet stream from the nozzle, and the downward velocity of the solid material which is a function of the depth of the borehole pipe 18.

To provide the most effective operation of the ejector, the nozzle or nozzles on the ejector are mounted so as to direct their air streams at an angle above the horizontal in order to compensate for the downward momentum of the solid fill material stream. In general, for example, at feed rates within a range from about 25 to about 100 tons per hour and a borehole having a depth from about 25 to 150 feet, such angle lies within a range from about 10° to about 50°. In a more specific example, a 50 ton per hour feed rate for the solid fill material down a 60 foot deep borehole would require the nozzles to be inclined at about a 22° angle above the horizontal in order to achieve a resultant generally horizontal air/fill material stream.

Utilizing the designs described above in accordance with the invention provides an improved technique for directing fill material into a subterranean void and has been found to project the fill material many times further than any known conventional systems currently in use or proposed for use. Moreover, since there are no mechanical wear points in the system of the invention which would occur due to the impinging of abrasive material on parts of the equipment used, the components of the system of the invention are much longer lasting and the overall cost of the system for long term use is considerably decreased.

While the specific embodiments of the invention as described above represent preferred embodiments thereof, modifications thereto may occur to those in the art within the spirit and scope of the invention. Hence, the invention is not to be construed as limited to the particular embodiments disclosed except as defined by the appended claims.

What is claimed is:

1. A system for filling a spatial volume below the earth's surface with a dry fill material comprising pipe means extending from said surface to said spatial volume, for allowing said dry fill material to fall therethrough in a generally vertical manner and exit therefrom in a vertically undeflected manner;

means for supplying dry fill material to the pipe means at said surface at a selected flow rate; and ejector means positioned below and radially outside the exit end of said pipe means for providing a high-velocity air stream to deflect the dry fill material as it exits vertically from the exit end of said pipe means whereby said dry fill material is directed in a direction generally horizontally away from said exit end of said pipe means into said spatial volume.

2. A system in accordance with claim 1 wherein said ejector means includes one or more nozzles connected to a source of high-pressure air for projecting one or more high-velocity air streams from said one or more nozzles at a selected velocity and in a direction at a selected angle above said horizontal direction.

3. A system in accordance with claim 2 wherein said angle is selected so that the momentum of each of said one or more air streams can be transferred to the dry fill material falling vertically from the exit end of said borehole means in a manner such that the resultant air and dry fill material mixture is projected substantially horizontally from the exit end of said borehole means.

4. A system in accordance with claim 3 wherein said angle is within a range from about 0° to about 50°, where the feed rate of said fill material into said borehole means has within a range from about 25 tons per hour to about 100 tons per hour and said borehole means has a depth from about 25 feet to about 100 feet.

5. A system in accordance with claim 4 wherein said angle is about 22+ and said borehole has a depth of about 60 feet.

6. A system in accordance with claim 5 wherein the air stream from said ejector means has a volume flow rate which lies within a range from about 1000 cubic feet per minute to about 2000 cubic feet per minute at a pressure of about 100 psig.

7. A system in accordance with claim 2 wherein said ejector means includes a plurality of nozzles connected to said high-pressure air source, said nozzles being spaced at selected peripheral positions around a portion of the exit end of said borehole means.

8. A system in accordance with claim 7 wherein said ejector means includes two nozzles.

9. A system in accordance with claim 1 wherein said ejector means includes a single nozzle.

10. A system in accordance with claim 1 wherein said one or more nozzles each provides a jet stream at supersonic velocities.

* * * * *